US006438871B1

(12) United States Patent
Culverwell

(10) Patent No.: US 6,438,871 B1
(45) Date of Patent: Aug. 27, 2002

(54) FOOTWEAR FASTENINGS

(76) Inventor: Steven John Culverwell, 1 Bath Place, Taunton, Somerset, TA1 4ER (GB)

( * ) Notice: Subject to any disclaimer, the term of this patent is extended or adjusted under 35 U.S.C. 154(b) by 0 days.

(21) Appl. No.: 09/743,068

(22) PCT Filed: May 23, 2000

(86) PCT No.: PCT/GB00/01970

§ 371 (c)(1),
(2), (4) Date: Jan. 4, 2001

(87) PCT Pub. No.: WO00/72716

PCT Pub. Date: Dec. 7, 2000

(30) Foreign Application Priority Data

May 26, 1999 (GB) ..... 9912139

(51) Int. Cl.[7] ..... A43C 11/00; A41F 1/00

(52) U.S. Cl. ..... 36/50.1; 24/578.14; 24/582.1; 24/592.1

(58) Field of Search ..... 36/50.1, 50.5; 24/592.1, 578.14, 582.1, 575.1

(56) References Cited

U.S. PATENT DOCUMENTS 780,020 A * 1/1905 Brent
1,711,419 A * 4/1929 Loofbourrow
2,266,083 A * 12/1941 Rzepa
4,157,622 A * 6/1979 Carlyle ..... 36/50.5
4,432,120 A * 2/1984 Sherman, Jr. et al.
4,470,175 A * 9/1984 Chiarella ..... 36/50.5
5,365,679 A * 11/1994 Chemello ..... 36/50.5

* cited by examiner

*Primary Examiner*—M. D. Patterson
(74) *Attorney, Agent, or Firm*—Ira S. Dorman

(57) ABSTRACT

An item of footwear has an opening 4 for insertion of a wearer's foot and a pair of rigid fastening elements 10 and 11 for drawing together opposite sides of the opening. The first element 10 has a screw thread 14 to receive a bead 15, and the free end of the second element 11 is bent orthogonally and formed into a U-shaped hook 16. When the wearer has placed his/her foot into the boot the element 10 is placed over the mouth of the hook 16. By applying gentle finger pressure the bead 15 is caused to ride over the shank of the second element 11 so that the hook 16 embraces the first element 10 and engages behind the bead 15. The tension in the fastening can be adjusted by screwing the bead 15 along the thread 14. The fastening is easy to engage and disengage when the wearer's fingers are cold or when wearing heavy gloves, yet the fastening is secure enough to be used with snowboarding or ski boots.

5 Claims, 1 Drawing Sheet

FOOTWEAR FASTENINGS

TECHNICAL FIELD OF THE INVENTION

This invention relates to fastenings for items of footwear.

BACKGROUND

Various kinds of fastening are known for securing an item of footwear onto a wearers foot, but many, like laces, are difficult to fasten when the wearer's fingers are cold or when wearing heavy gloves. Some kinds of fastenings are also difficult to secure tightly enough to be used with heavy boots as worn in snowboarding or skiing for example.

The present invention seeks to provide a new and inventive form of fastening.

SUMMARY OF THE INVENTION

The present invention proposes an item of footwear having an opening for insertion of a wearer's foot and fastening means for drawing together opposite sides of the opening to retain the footwear thereon, characterised in that said fastening means comprises first and second elements respectively associated with opposite sides of the opening, the first element being provided with a head and the second element being provided with a clasp portion for engagement behind said head.

The clasp portion is preferably disposed substantially perpendicular to the second element. The clasp portion preferably comprises a hook portion for engagement about said first element. The hook portion preferably has a mouth which, in use, is directed away from the wearers foot.

The head is preferably engaged with the first element for adjustment longitudinally thereof. The length of the fastening means may thereby be adjusted to vary the tightness of the fastening, for example to suit different wearers or compensate for different thicknesses of sock. The head may, for example, be engaged with a screw-threaded portion of the first element.

The head may be of any desired shape but is preferably substantially spherical.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
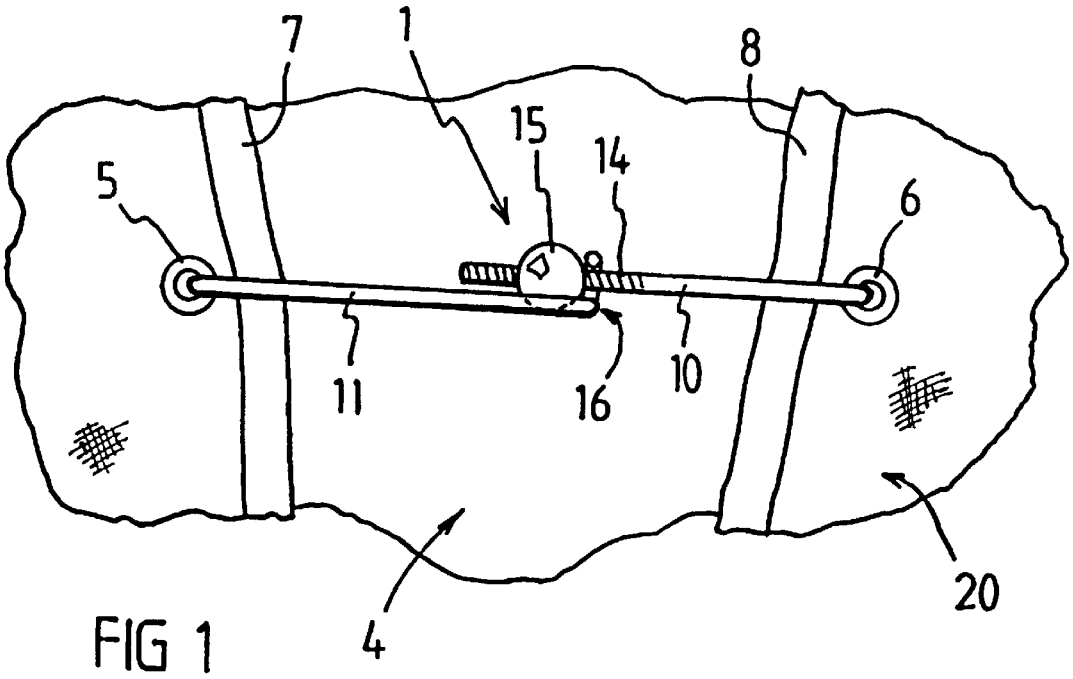
FIG. 1 is a front view of part of an item of footwear having a pair of fastening elements in accordance with the invention.

The drawing shows a fastening 1 as applied to a snowboard boot indicated generally at 20, although a similar form of fastening may be used with other kinds of footwear. The boot has an opening 4 with rows of eyelets 5 and 6 (only one eyelet on each side being shown) extending along opposite sides 7 and 8 of the opening. The eyelets are normally intended to receive a boot lace, but each pair of eyelets receives a pair of fastening elements 10 and 11 formed of stiff but slightly springy stainless steel wire or similar material. The elements are pivotally engaged with the eyelets, e.g. by inserting hooked ends through the eyelets. The elements could also carry back stops which locate behind the rear of the eyelets, in which case the elements are inserted by threading them through the eyelets from the rear. In boots of the kind in which some or all of the eyelets are replaced by hooked plates the elements may be provided with looped ends to pivotally engage the hooks.

Figure 2:
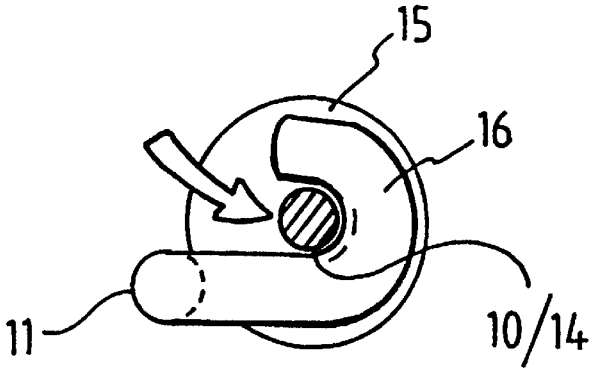
FIG. 2 is a detailed view of the elements looking from the right in FIG. 1.

The free end of the first fastening element 10 is formed with a screw thread 14 to receive a stainless steel bead 15, whereas the free end of the second element 11 is bent orthogonally and formed into a clasp in the form of a U-shaped, forwardly-directed hook 16, best seen in FIG. 2.

When the wearer has placed his/her foot into the boot the element 10 is placed over the mouth of the hook 16. By applying gentle finger pressure to the bead 15 the bead is caused to ride over the shank of the element 11, as indicated by the large arrow in FIG. 2, so that the shank of the first element 10 enters the mouth of the hook 16 so that the hook 16 embraces the first element 10 and engages behind the bead 15. The tension in the fastening can be adjusted by changing its length, which is easily achieved by screwing the bead 15 along the thread 14.

It should be appreciated that when the boot is being worn the fastening is primarily subjected to tensile stress so that the fastening is able to withstand considerable tension without coming apart due to the engagement of the hook 16 behind the bead 15. On the other hand, application of moderate forwardly-directed finger pressure to the first element 10 and/or the bead 16 will cause the bead to ride over the second element 11 and thereby disengage the fastening.

Thus, the fastening is easy to engage and disengage when the wearer's fingers are cold or when wearing heavy gloves, yet the fastening is secure enough to be used with snowboarding or ski boots.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. An item of footwear having an opening (4) for insertion of a wearer's foot, and fastening means for drawing together opposite sides (7, 8) of the opening to retain the footwear thereon, said fastening means comprising first and second elements (10, 11) respectively associated with opposite sides of the opening, the first element (10) having a first shank provided with a head (15) and the second element (11) having a second shank provided with a laterally-projecting hook portion (16) for engagement behind said head, said hook portion being disposed substantially perpendicular to said second shank for engagement about said first shank.

2. An item of footwear according to claim 1, including means for engaging said head (15) with said shank (10) for adjustment to selected positions longitudi-nally of said first shank.

3. An item of footwear according to claim 2, wherein said means for engaging comprises a screw-threaded portion (14) of the first shank.

4. An item of footwear according to claim 1, in which the head (15) is substantially spherical.

5. An item of footwear according to claim 1, in which the dimensions of said hook portion are such that the head abuts the second shrank when the hook portion is engaged about the first shank.

* * * * *